United States Patent [19]

Custeau

[11] Patent Number: 4,865,188

[45] Date of Patent: Sep. 12, 1989

[54] PAINT BRUSH CLEANING ASSEMBLY

[76] Inventor: Lincoln Custeau, 404 Notre-Dame Street, Robertsonville, Canada, G0N 1L0

[21] Appl. No.: 222,075

[22] Filed: Jul. 20, 1988

[51] Int. Cl.[4] ..... B08B 3/04; B65D 81/00

[52] U.S. Cl. ..... 206/209; 134/201; 206/15.2

[58] Field of Search ..... 134/201; 206/209, 361, 206/15.2, 209.1, 362, 362.1, 362.2, 362.3, 15.3; 401/131

[56] References Cited

U.S. PATENT DOCUMENTS

| | | | |
|---|---|---|---|
| 363,983 | 5/1887 | Brooks | 206/15.2 X |
| 1,204,531 | 11/1916 | Wright | 206/15.3 |
| 2,141,531 | 12/1938 | Graham | 206/15.2 |
| 2,562,496 | 7/1951 | Kirsch | 206/361 |
| 2,654,504 | 2/1950 | Hyams . | |
| 2,815,057 | 12/1957 | Tupper | 206/362.2 X |
| 2,990,076 | 6/1961 | Stull | 206/15.2 X |
| 3,156,364 | 11/1964 | Wolcott | 206/209 X |
| 3,527,341 | 9/1970 | Peebles | 206/209 |
| 3,851,782 | 12/1974 | Clawson et al. . | |

FOREIGN PATENT DOCUMENTS

| | | | |
|---|---|---|---|
| 463292 | 2/1950 | Canada . | |
| 826430 | 1/1960 | United Kingdom | 206/209 |

*Primary Examiner*—Philip R. Coe

[57] ABSTRACT

A cleaning assembly for cleaning the bristles of a paint brush, comprising in combination a container having a top mouth and a bottom flooring, a paint solvent into the container, a paint brush having a handle and bristles the latter bathing into the solvent, a cover having a bottom mouth, the mouths of the cover and container being releasable sealingly interconnected and the paint brush being frictionally interconnected to the cover and/or the container at the level of narrowed sections thereof. The bristles then hang spacedly over the container flooring. The securing of the paint brush to the cover/container assembly is characterized in that it prevents relative movement of said paint brush.

3 Claims, 2 Drawing Sheets

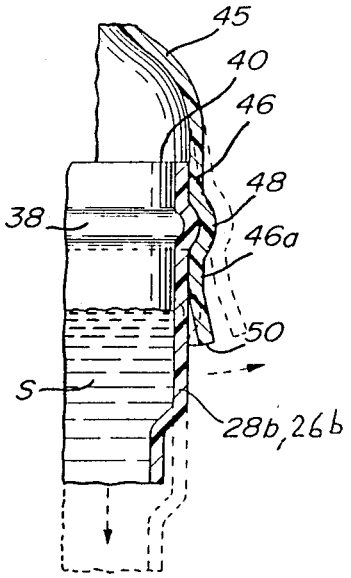
FIG. 6
FIG. 5
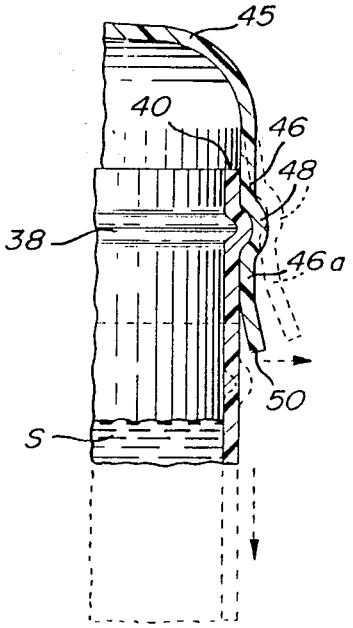
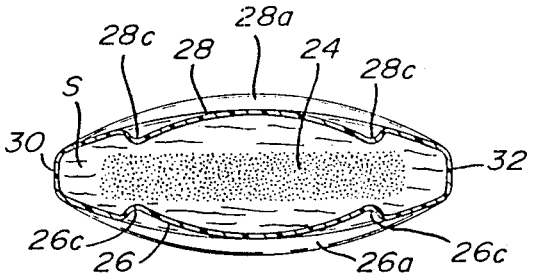
FIG. 4
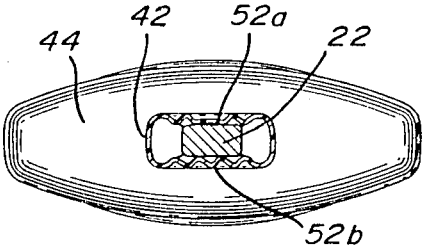
FIG. 3

PAINT BRUSH CLEANING ASSEMBLY

FIELD OF THE INVENTION

This invention relates to tools for painters.

BACKGROUND OF THE INVENTION

Paint brushes of good quality can command relatively high prices, and accordingly it is preferable that a paint brush be used more than once. However, as is known in the field, after a first use of the brush with paint, the bristles thereof will harden under the action of the paint remaining both around each thread and between groups of adjacent "interconnected" threads, unless an approprite solvent such as "VARSOL" is used to thoroughly clean the bristles. For the cleaning to be effective, the worker needs to bath the bristles for a long period of time into a solvent container. During this lapse of time, deleterious odors emanate from the container, said odors being dangerous to inhale and also dangerous in that, being generally derived from petroleum by-products, they can cause an explosion if a match or the like is sparked. Also, residues of paints aggregate on the bottom of the container, and the bristles will stagnate into these residues under the bias of the weight of the paint brush, and also the bristles will curl and bend under said weight wherein the bristles will loose their texture a good texture for paint brush bristles is important for a good paint job as is well known.

These problems were addressed in the art by various contraptions, which have not it seems satisfied the customer since such products are not on the market. A typical example is that one shown in U.S. Pat. No. 2,654,504 issued in 1953 to Mr. Hyams. In this patent, to the mouth of a paint can 2 is mounted a transverse rod 12 engaging through a bore 13 made at the intermediate section of the handle of a paint brush. The bristles can therefore bath in a solvent within the can 3, and since the brush is hanged, the bristles 14 are spaced from the flooring of the can. A cover 15 releasably closes the mouth of the can.

OBJECTS OF THE INVENTION

The primary object of the present invention is to increase the useful lifetime of a paint brush by enabling repeated use thereof without adverse effect to the straightness of the bristles thereof.

Another object of the invention is to provide cleaning means for the bristles of a paint brush, to prevent evaporation and to eliminate odors from the solvent during the cleaning of the bristles between uses of the paint brush.

An object of the invention is to provide cleaning means for the bristles of a paint brush, which will be effective for the whole duration of the storage of the paint brush between uses and which will ensure thorough cleaning.

Still another object of the invention is to provide such cleaning means as disclosed hereinabove, which have safety locking means to prevent small children from having direct access to the paint solvent of the cleaning means.

An object of the invention is that the cleaning means be adaptable to a number of paint brushes having different widths of bristle and handle sections.

A further object of the above invention is its simplicity of construction and use and its low manufacturing cost.

SUMMARY OF THE INVENTION

In accordance with the objects of the invention, there is disclosed a cleaning assembly for cleaning the bristles of a paint brush, comprising in combination a container having a top mouth and a bottom flooring, a paint solvent into said container, a paint brush having a handle and bristles the latter bathing into said solvent, a cover having a bottom mouth, joint means to releasably sealingly interconnect said mouths of the cover and container, and securing means to retain said paint brush so that said bristles hand spacedly over said container flooring; said securing means being characterized in that it prevents movement of said paint brush relative to the container and cover.

Preferably, said cover is made of a semi-resilient material, said securing means consisting of at least two facing parts of a substantially cross-sectionally ovoidal narrowed section of said cover which are spaced by a distance usually smaller than the thickness of said handle but which can be spread apart by a distance greater than said thickness, so that a friction fit locking engagement be established between said brush handle and said cover ovoidal section.

Profitably, said cover ovoidal section facing parts have a wavy shape in cross-section, these "waves" extending along an axis substantially orthogonal to the axis of said handle.

Preferably, said paint brush also defines a collar interconnecting said handle to said bristles, said container being of substantially cross-sectionally ovoidal shape and made of a semi-resilient material, and further including a few lengthwise involutions in the two main facing walls of the ovoidal container to reinforce said container.

Said semi-resilient material could be high-density polyehtylene.

Preferably, said joint means consists of an annular flange, defined by the walls of said container surrounding the mouth thereof, and an annular lip, defined by the walls of said cover surrounding the mouth thereof, said annular lip being made of a semi-resilient material and frictionally releasably abutting against the outer face of said annular flange.

Advantageously, the free end of said annular lip is prebiased to a slightly outwardly divergent position, for facilitating manual grasping thereof for pulling the lip from the container in order to release the cover from the container.

Profitably, said annular lip comprises an annular outturned ridge near the free edge thereof, and said annular flange comprises a similar annular outturned ridge releasably frictionally engaging the first-mentioned ridge.

Preferably, said cover shapingly conforms to said handle but at a slightly larger scale, said annular lip being substantially flat and downturned and also upwardly merging with an inwardly upwardly curved intermediate cover section, the top free edge of said container coming in exact register with the intersection of said annular lip and said curved cover section when said flange and lip ridges engage each other; wherein said joint means further includes the frictional coaction between the top edge section of said annular flange and said cover section which is biased thereagainst by its inturned curvature.

It would be desirable that there be further included an ear member, at the top of said cover, to enable hanging of the interconnected cover and container during storage period concurrently with the bathing of the bristles in the solvent.

BRIEF DESCRIPTION OF THE DRAWINGS

FIGS. 3–4 are cross-sectional views taken along lines 3—3 and 4—4 respectively of FIG. 1;

FIG. 5 is an enlarged view taken within circle 5 of FIG. 1; and

FIG. 6 is a view similar to that of FIG. 5 but for an alternate embodiment of the invention.

DETAILED DESCRIPTION OF THE INVENTION

Figure 2:
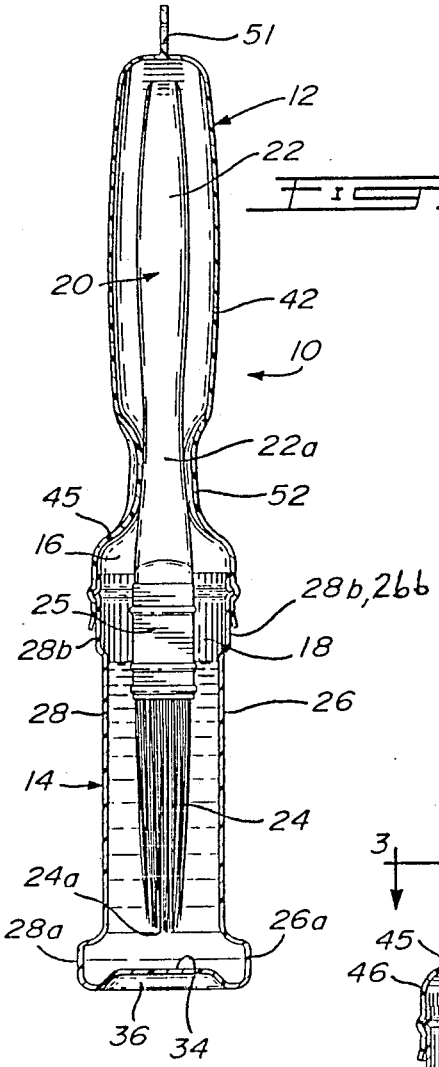
FIG. 2 is a vertical side sectional view of the elements of FIG. 1.

Paint brush cleaning assembly 10 consists of top and bottom parts 12, 14 defining two mouths 16, 18 which are engageable into each other so as to form a structure similar to but at a slightly enlarged scale than paint brush 20. Brush 20 defines a handle 22, a plurality of bristles 24 and a collar 25 to fixedly interconnect the bristles to the handle. The brush 20 is thin but wide, and is of substantially same thickness along its length but is of variable width with the bristle section 24 being much wider than the handle section 22. Of course, support assembly 10 is designed for a variety of paint brushes 20 having bristle sections of various widths.

Bottom portion 14 defines front and rear main convex walls 26–28 which are interconnected by relatively narrow side walls 30, 32. The lower sections of main walls 26–28 are slightly outturned at **26*a*, 28*a* to define a support base flooring 34 about 50% larger than the distance between walls 26 and 28, whereby portion 14 may stand upright with the mouth thereof 18 opening upwardly. Flooring 34 may have a widthwise inward recess or cavity 36 to increase stability of portion 14 in its upright position. Portion 14 is used as a container or can, to receive a fluid such as a paint solvent e.g. turnpentine S. Hence, the bristles 24 of the paint brush 20 may bath into the solvent S contained in can 14. Can 14 is also provided with an annular outturned ridge 38, at the upper section thereof but short of its top edge 40, for a purpose later set forth; said upper section may further be slightly outturned at 26*b*, 28*b*, see FIGS. 2 and 6. The distance between walls 26 and 28 is larger than the thickness of bristle section 24, and the distance between sides 30 and 32** is larger than the width of said bristle section.

Top part 12 defines a handle section 42, an enlarged mouth section 44, an outwardly downwardly (concavely) curved lower section 45, and a flattened annular lip 46 downwardly depending from the outer edge of section 45. Lip 46 includes an outturned annular ridge 48 near to but at a distance from its free edge 50. Lip 46 is made of a semi-flexible material and is adapted to flatly frictionally abut against the outer face of the upper section of container 14, with outturned ridges 38, 48 being in interlocking engagement; and the play between the lip free edge 50 and the container walls 26, 28 (or **26*b*, 28*b*) enables a user to easily pull out the semi-flexible lip 46 therefrom to release parts 12 and 14** from each other.

Hence, a releaseable joint is formed, which prevents egress of unpleasant solvent odors from can 14 together with preventing evaporation thereof.

An important feature of this joint between parts 12 and 14 is in the way walls 26–28 coact with walls 45–46. More specifically, as best shown in FIGS. 5–6, the radius of curvature of wall 45 should be carefully studied in relation to the relative position of annular ridge 48, whereby when container 14 is engaged into mouth 16 and annular ridge 38 engaged in friction fit fashion into the annular cavity defined by exterior ridge 48, the top edge 40 of container 14 should come in exact register with the beginning of the curvature of wall 45. That is to say, a friction fit should also be established between the top edge wall sectoin 40 of container 14, and the downwardly depending wall section 46 of cover 12, by abutting against the slightly inwardly extending intersection of curved section 45 and wall 46.

The top end of handle section 42 may have an outturned ear 51, to permit the hanging of interconnected parts 12, 14 by a hook means such as a nail engaging the bore **51*a* of ear 51**.

Walls 26–28 have an oval or convexo-convex shape, so as to obtain a better seal at covet joint 38, 48, also in order to maximize rigidity of the container 14, and moreover to improve styling.

In accordance with another feature of the invention, there is disclosed means to retain the brush 20 into parts 12, 14, whereby the bottom edge of bristles 24 at **24*a* extends short of flooring 34. Such retaining means may include a narrowed section of wall 42 at 52, that is at the lower section of wall 42. Narrowed section 52 is clearly shown in FIG. 3 in cross-section, and is substantially rectangular in cross-section. The front and rear walls 52*a*, 52*b* have a wavy shape in cross-section with the distance between facing troughs of these opposite walls being smaller than the thickness of the handle 22. At least narrowed wall section 52*a*, and preferably all of cover part 12, is made of semi-resilient material such as high-density polyethylene whereby the irregularly shaped wall sections 52*a*, 52*b* an be forcibly pushed away from each other, upon passage of handle 22 therebetween. Thus, handle 22 will be frictionally held in place by friction fit with wall sections 52*a*, 52*b***.

Figure 1:
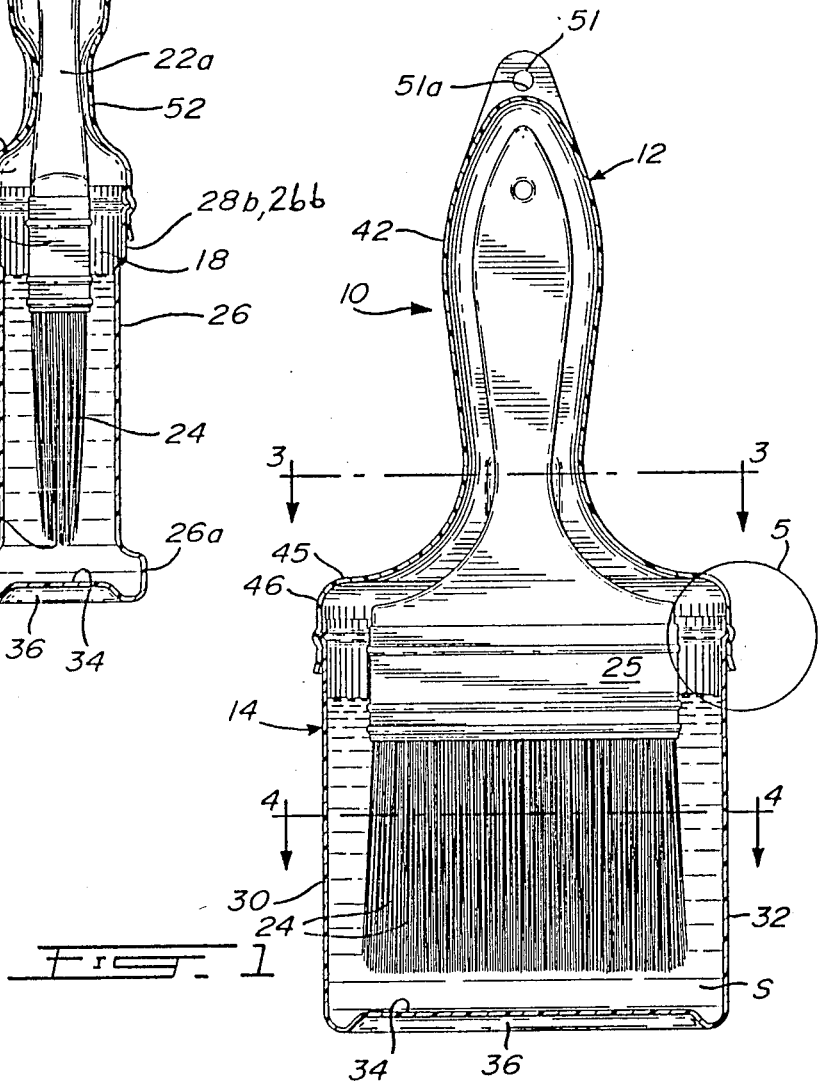
FIG. 1 is a vertical front sectional view of a support assembly in accordance with the invention, with a paint brush shown in full lines and in upright position.

In many paint brushes, the handle has an intermediate section which is slightly thinner than the remainder thereof, shown at **22*a* in FIG. 2. Preferably, the position of narrowing 52 of top part 12 should be such that when engaging the thin section 22*a* of handle 22, the bristles 24 hang at a distance from flooring 34 as clearly shown in FIGS. 1–2**.

Vertically extending involuted sections **26*c*, 28*c* of walls 26, 28 (or 26*b*, 28*b*) of solvent container 14 (see FIG. 4) serve as reinforcement for the container. Involutions 26*c* face involutions 28*c*. In such an embodiment, container 14** should be made of a semi-resilient material such as high-density polyethylene.

The support assembly 10 is used in the following manner. After the plant brush 20 has been used and its bristles 24 are full of paint, the worker grabs the collar 25 with his thumb and another finger from same hand to draw the handle 22 through the mouth 16 of cover 12; with his other hand, he then holds cover 12, wherein with his first hand he pushes the handle 22 further into cover, forcibly through narrowing 52 and therebeyond until collar 25 and thus his two grasping fingers register with the free edges 50 of cover 12. Then, mouths 16–18 are brought toward each other and lip 46 is brought against upper wall sections 26*b*, 28*b*, to enable snap locking and sealing engagement between annular ridges 38 and 48. Bristles 24 now bath into solvent S contained in can 14.

Interconnected parts 12, 14 now define an integral sealed assembly 10.

Assembly 10 remains in upright position, to allow the paint around the bristles to fall down to flooring 34 under the action of solvent S and of the gravitational pull.

When all the paint has fallen to flooring 34, cover 14 is released from container 12 by the worker lifting diverging lip 50 from wall 26 or 28, and by pulling the cover outwardly from mouth 18.

It can now be understood that retaining the paint brush 20 so that the free ends 24*a* of its bristles 24 stay clear of flooring 34, not only prevents those bristles free ends from undesirably coming in contact with the paint residues progressively gathering on flooring 34, but also prevents these bristles end tips from being flattened by compression against the flooring under the weight of the paint brush and thus reduces wear of the bristles i.e. increases the useful lifetime of the paint brush.

I claim:

1. A cleaning assembly for cleaning the bristles of a paint brush, comprising in combination a container having a top mouth and a bottom flooring, a paint solvent in said container, a paint brush having a handle and bristles the latter bathing into said solvent, a cover having a bottom mouth, joint means to releasably sealingly interconnect said mouths of the cover and container, the joined cover and container completely enclosing said paint brush and securing means to retain said paint brush so that said bristles hang spacedly over said container flooring; said securing means being characterized in that it prevents movement of said paint brush relative to said container and cover; wherein said paint brush also defines a collar interconnecting said handle to said bristles, said container being of substantially cross-sectionally ovoidal shape and made of a semi-resilient material, and further including a few lengthwise involutions in the two main facing walls of the ovoidal container to reinforce said container.

2. The assembly as defined in claim 1, wherein said semi-resilient material is high-density polyethylene.

3. A cleaning assembly for cleaning the bristles of a paint brush, comprising in combination a container having a top mouth and a bottom flooring, a paint solvent in said container, a paint brush having a handle and bristles the latter bathing into said solvent, a cover having a bottom mouth, joint means to releasably sealingly interconnect said mouths of the cover and container, the joined cover and container completely enclosing said paint brush and securing means to retain said paint brush so that said bristles hang spacedly over said container flooring; said securing means being characterized in that it prevents movement of said paint brush relative to said container and cover; said joint menas consisting of an annular flange, defined by the walls of said container surrounding the mouth thereof, and an annular lip, defined by the walls of said cover surrounding the mouth thereof, said annular lip being made of a semi-resilient material and frictionally releasably abutting against the outer face of said annular flange; the free end of said annular lip being prebiased to a slightly outwardly divergent position, for facilitating manual grasping thereof for pulling the lip from the container in order to release the cover from the container; said annular lip comprising an annular outturned ridge near the free edge thereof, and said annular flange comprises a similar annular outturned ridge releasably frictionally engaging the firstmentioned ridge; wherein said cover shapingly conforms to said handle but at a slightly larger scale, said annular lip being substantially flat and downturned and also upwardly merging with an inwardly upwardly curved intermediate cover section, the top free edge of said container coming in exact register with the intersection of said annular lip and said curved cover section when said flange and lip ridges engage each other; and wherein said joint means further includes the frictional coaction between the top edge section of said annular flange and said cover section which is biased thereagainst by its inturned curvature.

* * * * *